United States Patent [19]

Goddard

[11] Patent Number: 4,477,416

[45] Date of Patent: Oct. 16, 1984

[54] SALT ROASTING OF VANADIUM ORE IN THE PRESENCE OF CARBON

[75] Inventor: John B. Goddard, Grand Island, N.Y.

[73] Assignee: Union Carbide Corporation, Danbury, Conn.

[21] Appl. No.: 424,641

[22] Filed: Sep. 27, 1982

[51] Int. Cl.[3] ..... C01G 31/00; C01G 31/02

[52] U.S. Cl. ..... 423/67; 423/62; 423/63; 423/68

[58] Field of Search ..... 423/62, 65, 68, 67

[56] References Cited

U.S. PATENT DOCUMENTS

| | | | |
|---|---|---|---|
| 831,280 | 9/1906 | Handy | 423/68 |
| 2,187,750 | 1/1940 | Marvin | 423/68 |
| 3,656,936 | 4/1972 | Haas | 75/101 R |
| 3,792,150 | 2/1974 | Maxwell et al. | 423/62 |
| 4,087,510 | 5/1978 | Steenken | 423/62 |
| 4,243,639 | 7/1973 | Haas et al. | 423/68 |
| 4,389,378 | 6/1983 | McCorriston | 423/62 |

FOREIGN PATENT DOCUMENTS

| | | | |
|---|---|---|---|
| 1331932 | 9/1973 | United Kingdom | 423/62 |

*Primary Examiner*—Herbert T. Carter
*Attorney, Agent, or Firm*—John R. Doherty

[57] ABSTRACT

A process is provided for extracting vanadium values from a vanadium-bearing ore in which a carbonaceous material is added to a salt roast mixture containing ore and an alkali metal salt, e.g., NaCl. The mixture is subjected to roast temperatures (e.g., 825° C.) for a period of time sufficient to burn off substantially all of the carbon in the mixture. The carbonaceous material is preferably a vanadium-containing carbon source, e.g., residue from the combustion of heavy petroleum oil.

15 Claims, No Drawings

SALT ROASTING OF VANADIUM ORE IN THE PRESENCE OF CARBON

DESCRIPTION

1. Technical Field

The present invention relates to the extraction of vanadium values from vanadium-bearing ores and more particularly relates to an improved process for extracting vanadium from a vanadium ore by roasting the ore together with a metallic salt and then water leaching the roast residue to dissolve soluble vanadium values. In one important aspect, the present invention contemplates the extraction of vanadium from a vanadium-bearing ore in significantly improved yields by the addition to the roast of a carbonaceous material and particularly a carbonaceous material containing vanadium.

2. Background Art

Salt roasting vanadium ores to produce soluble vanadates is a well known process in the art. The vanadates so produced can be leached from the roast residue with water or with aqueous solutions of acids or bases, and the vanadium can be recovered from the aqueous leach liquor by a variety of known and efficient processes.

However, it is also well known that vanadium ores cannot be successfully salt roasted and water-leached by conventional practices to produce vanadium in significantly high yields. Acid or basic leaching often will improve the vanadium extraction to a certain degree, although some vanadium is invariably left behind. Optimum salt-roast, water-leach recoveries in the range of between 80–90% are generally considered to be good.

It has been found in accordance with the present invention that the salt-roast, water-leach extraction of vanadium from vanadium-bearing ores can be significantly improved if a carbonaceous material, e.g., charcoal, coke, etc., is added to the ore before salt roasting. The beneficial effect of the presence of carbon is surprising since while on the one hand carbon is a good reducing agent, a successful salt roast generally requires the vanadium to be oxidized to the pentavalent state in order to form a water-soluble vanadate such as sodium metavanadate ($NaVO_3$). It would therefore be logical to expect the presence of carbon to hinder rather than promote oxidation of the vanadium. Actually in practice, carbonaceous ores containing relatively large amounts of carbon have been shown to give poor salt-roast vanadium recoveries when compared to similar processes using noncarbonaceous ores, e.g., certain dolomitic shales.

It has also been surprisingly found that while large amounts of carbon generally can be detrimental in a normal salt-roast operation, virtually any amount of carbonaceous material can be employed to improve the vanadium extraction so long as sufficient time is allowed during the roast operation to burn off substantially all of the carbon.

It has been further surprisingly found that synergistic recoveries of vanadium can be achieved during the salt-roast, water-leach extraction process if a carbonaceous material is employed which also contains some vanadium. Such vanadium-containing carbonaceous materials are available from a variety of sources such as petroleum, for example.

Accordingly, an important object of the present invention is to provide an improved process for extracting vanadium values from a vanadium-bearing ore by salt-roasting the ore in the presence of carbon and then water-leaching the roast residue to recover soluble vanadates.

A more specific object of the present invention is to provide such an improved process in which synergistic recoveries of vanadium are possible by employing a vanadium-containing carbonaceous material in the roast.

DISCLOSURE OF THE INVENTION

In accordance with the present invention, an improved process is provided for extracting vanadium values from a vanadium-bearing ore which comprises, in combination:

preparing a finely divided mixture of the vanadium-bearing ore, a carbonaceous material and an alkali metal salt;

roasting the mixture so prepared in an oxidizing atmosphere at an elevated temperature sufficient to promote oxidation of the vanadium and formation of a water soluble vanadate, and for a period of time sufficient to burn off substantially all the carbon in the mixture;

leaching the roast residue with an aqueous solution to dissolve the water soluble vanadate; and recovering the vanadate from the aqueous leach liquor.

Although an exact explanation of the mechanism by which the addition of carbonaceous material to the roast results in improved vanadium yields cannot be given at this time, it is believed nevertheless that the carbon addition in some way results in an increase in the rate of conversion of vanadium in the ore to the water soluble vanadate and thus retards the conversion of the vanadium into other insoluble forms. The amount of carbonaceous material employed in the mixture is not altogether critical so long as sufficient time is allowed to burn off substantially all the carbon during the roast operation.

It has been furthermore found in accordance with the present invention that synergistic vanadium recoveries are possible if the carbonaceous material employed in the salt-roast, water-leach process also contains some vanadium. Such vanadium-containing carbonaceous materials are available from a number of sources such as ash produced by combustion of nonvolatile (heavy) fractions of certain petroleum oils.

DETAILED DESCRIPTION

In the practice of the present invention, a vanadium-bearing ore (e.g., vanadiferous clay), carbonaceous material such as charcoal or petroleum coke and an alkali metal salt, e.g., NaCl, are blended together as powdered materials. The particle size of the ingredients is not critical, although the powders should be fine enough for efficient blending and reasonably rapid reaction at the roast temperature. Typically, the mixture ingredients are ground to at least −100 mesh (150 μm). The proportion of the ingredients used in the mixture will vary with each ore; for example, approximately 12% by weight NaCl has been used in roasting an Arkansas vanadiferous clay containing about 1.3% by weight $V_2O_5$. The blended mixture may be roasted in the form of a loose mix or the blend may be pelletized or extruded after adding a small amount of water. A conventional calcining furnace may be used to carry out the roast operation. Roasting of the mixture may be accomplished in air, oxygen or oxygen-enriched air. When roasting with NaCl, water vapor should also be employed as a component of the roast atmosphere. The optimum temperature of the roast will vary somewhat depending on the particular vanadium ore employed. For high-silica ores such as clays, a roast temperature in the range of 800° to 850° C. is recommended.

The optimum roast time also will vary with the furnace charge and with the temperature of the roast. Generally, one to four hours should be sufficient. As indicated, sufficient time must be allowed for substantially all the carbon in the mixture to burn off. This will of course depend upon the amount of carbon actually used in the mixture and also on the rate of diffusion of gases through the furnace charge.

After the roast has been completed, the roast residue or calcines are water-leached to dissolve the formed vanadate, e.g., $NaVO_3$. The conditions for this step are not critical although it is generally preferred to carry out the leaching operation at temperatures above ambient. These higher temperatures generally result in increased reaction rates and more complete leaching of the vanadium ore. It is also preferable to crush the calcines before leaching in order to expose more surface area to the leached solution and thereby increase the effectiveness of the leaching step. Generally, the calcines should be reduced in size to approximately 8 mesh or finer.

The water leached residue may be subjected to a further leaching step, if desired, using an acidic or alkaline leach solution to improve recoveries of vanadium. However, this has often been found economically unwarranted and can pose serious effluent disposal problems.

The vanadium-containing aqueous solution can be treated by known processes to recover vanadium. For instance, the solution may be treated with an ammonium salt, such as $(NH_4)_2SO_4$ or $NH_4Cl$, to precipitate ammonium metavanadate ($NH_4VO_3$). The ammonium vanadate can be calcined to $V_2O_5$ or reduced to $V_2O_3$. Alternatively, the vanadium may be extracted from the leach solution by a water-insoluble tertiary amine in a hydrocarbon solvent and then stripped from the amine with an aqueous ammonium solution. Relatively pure $NH_4VO_3$ is then crystallized from the strip solution by adding $(NH_4)_2SO_4$ or $NH_4Cl$. Other methods for recovering vanadium from the leach solution may of course be employed.

Other alkali metal salts besides NaCl can of course be used in the practice of the present invention. Such alkali metal salts include, for example, KCl, $Na_2SO_4$, $NaNO_3$, $Na_2CO_3$, as well as mixtures of these and other salts. Generally, NaCl is preferred for silica-matrix ores such as clay because of its cost effectiveness.

Air is the most convenient atmosphere for carrying out the roasting operation since it contains both water and oxygen. However, the roast atmosphere can be fortified with water or oxygen or both, if desired, to increase the rate of the salt-roast conversion reactions.

As indicated above, it is preferable to employ a carbonaceous material in the blended mixture which contains some vanadium. Vanadium-containing carbonaceous materials are available from a number of different sources. Petroleum, for example, contains at least some trace amounts of vanadium, e.g., petroleum from Venezuela typically contains more vanadium than other petroleum sources. During refining, the vanadium concentrates in the nonvolatile (heavy) fractions of the oil. The heavy oil typically is used as a fuel and vanadium concentrates in the ash that results from combustion. Vanadium-bearing, high-carbon residues are also obtainable from other processes such as "Flexicoking" in which heavy crudes are refined to produce useful volatile products. It has been found by adding such vanadium-containing carbon materials to vanadium ore, followed by salt roasting and water leaching as described, the leach tails are actually lower in vanadium than the leach tails from an analogous roast prepared with only vanadium ore. This is so even though the feed grade is higher for the blend of ore and vanadium-containing carbon source. These improved recoveries of vanadium are "synergistic", i.e., the additional vanadium extracted from the blend of ore and vanadium-containing carbon source over that extracted from ore alone is greater than the additional vanadium supplied by the vanadium-containing carbon source. Assuming 100% extraction of vanadium from the added vanadium-containing carbon source, the calculated extraction of vanadium from the ore is still better than in the case where the vanadium-containing carbon source is omitted.

The following examples illustrate the practice of the present invention:

EXAMPLE I

An Arkansas vanadiferous clay containing 1.293% $V_2O_5$ was sized to −100 mesh (−150 μm). The clay was blended with varying amounts of charcoal also sized to −100 mesh, plus pulverized NaCl. Generally, the amount of salt added equalled about 12% of the sum of the weights of the other components. This amount of salt was almost optimum for this particular ore. One blend was prepared without the addition of charcoal and this blend was used as the control. The charcoal was analyzed to contain 93% C and 1.4% ash. Six-ten ml water was added to each blend and each was pressed into one inch diameter cylinders. These cylinders were then roasted for 2 or 4 hours at 825° C. In this particular example, the cylinders were roasted in groups of five at a time. The roast was carried out in an atmosphere of air containing water vapor. The calcines were cooled in air, crushed, and leached one hour in boiling water. The slurry was then filtered and the residue rinsed and dried. The calculated percentage of $V_2O_5$ extracted was based on filtrate and residue analysis. The results of the test are given in Table I below.

TABLE I

Effect of Charcoal on Roasting Vanadiferous Clay, Charcoal and Salt at 825° C.

| Test | Ore (g) | Charcoal (g) | NaCl (g) | Leach Tails Wt (g) | Leach Tails % $V_2O_5$ | % $V_2O_5$ Extd |
|---|---|---|---|---|---|---|
| | | Group I. Roast Time 2 hr | | | | |
| 1 | 50.0 | 0 | 6.00 | 47.3 | 0.24 | 82.2 |
| 2 | 50.0 | 5.00 | 6.60 | 47.6 | 0.33 | 76.1 |
| 3 | 50.0 | 0.05 | 6.01 | 47.3 | 0.21 | 84.3 |
| 4 | 30.0 | 15.00 | 5.40 | 29.1 | 1.12 | 13.2 |
| 5 | 50.0 | 0.50 | 6.06 | 47.4 | 0.17 | 87.3 |
| | | Group II. Roast Time 2 hr | | | | |
| 6 | 50.0 | 0 | 6.00 | 47.4 | 0.24 | 82.4 |
| 7 | 45.0 | 9.00 | 6.48 | 43.3 | 1.11 | 18.5 |
| 8 | 50.0 | 0.10 | 6.01 | 47.3 | 0.22 | 83.7 |
| 9 | 50.0 | 2.50 | 6.30 | 47.3 | 0.15 | 88.8 |
| 10 | 50.0 | 1.00 | 6.12 | 47.4 | 0.17 | 87.4 |
| | | Group III. Roast Time 4 hr | | | | |
| 11 | 50.0 | 0 | 6.00 | 47.5 | 0.20 | 85.2 |
| 12 | 50.0 | 0.05 | 6.01 | 47.5 | 0.20 | 85.2 |
| 13 | 50.0 | 2.50 | 6.30 | 47.5 | 0.16 | 86.9 |
| 14 | 50.0 | 0.10 | 6.01 | 47.6 | 0.20 | 85.2 |
| 15 | 50.0 | 0.50 | 6.06 | 47.6 | 0.18 | 86.8 |

TABLE I-continued

Effect of Charcoal on Roasting Vanadiferous Clay, Charcoal and Salt at 825° C.

| Test | Ore (g) | Charcoal (g) | NaCl (g) | Leach Tails Wt (g) | Leach Tails % $V_2O_5$ | % $V_2O_5$ Extd |
|---|---|---|---|---|---|---|
| | | Group IV. Roast Time 4 hr | | | | |
| 16 | 50.0 | 0 | 6.00 | 47.5 | 0.18 | 86.5 |
| 17 | 20.0 | 20.00 | 4.80 | 19.1 | 0.47 | 65.4 |
| 18 | 50.0 | 0.05 | 6.01 | 47.4 | 0.19 | 85.9 |
| 19 | 50.0 | 5.00 | 6.60 | 47.5 | 0.13 | 90.2 |
| 20 | 50.0 | 1.00 | 6.12 | 47.4 | 0.16 | 88.3 |
| | | Group V. Roast Time 4 hr | | | | |
| 21 | 50.0 | 0 | 6.00 | 47.6 | 0.20 | 85.6 |
| 22 | 30.0 | 15.00 | 5.40 | 28.3 | 0.32 | 75.9 |
| 23 | 50.0 | 0.25 | 6.03 | 47.5 | 0.17 | 87.7 |
| 24 | 45.0 | 9.00 | 6.48 | 42.9 | 0.13 | 90.6 |
| 25 | 50.0 | 0.10 | 6.01 | 47.6 | 0.18 | 86.8 |

It will be seen from Table I that vanadium extraction is improved whenever the leach residue (tails) is lower in % $V_2O_5$ than that of the control test. For the two-hour roast, improved results were obtained for runs with charcoal in amounts of from 0.1% to 5% of the ore weight. For the four-hour roast, the 0.1%—charcoal addition (test 12) and the 0.2%—charcoal additions (tests 14 and 25) showed only slight improvement if any. Better recoveries are generally seen for four-hour roast periods to the point where the addition of 0.2% carbon or less was of little or no benefit.

The results in Table I show clearly that vanadium extraction from high-carbon blends may be significantly improved if the roast time is extended. Sufficient time must be allowed for the carbon to burn off. The presence of unburned carbon was visibly evident within the calcined pellets for tests 4 and 7 for which poor extractions were obtained.

EXAMPLE II

The same procedures outlined in Example I were followed to prepare various blends containing the vanadiferous clay except that in this instance other carbon sources were used besides charcoal, i.e., petroleum coke and a medium-volatile bituminous coal (69% fixed C,3% ash). The roast was carried out for a period of two hours. The test results are given in Table II below and clearly indicate that other sources of carbon can be used as well to enhance vanadium extraction.

TABLE II

Effect of Petroleum Coke and Coal on Salt Roasting Vanadiferous Clay 2 Hr at 825° C.

| Test | Ore (g) | Pet. Coke (g) | Coal (g) | NaCl (g) | Leach Tails Wt (g) | Leach Tails % $V_2O_5$ | % $V_2O_2$ Extd |
|---|---|---|---|---|---|---|---|
| 26 | 50.0 | 0 | 0 | 6.00 | 47.2 | 0.28 | 79.6 |
| 27 | 50.0 | 0.50 | 0 | 6.06 | 47.5 | 0.21 | 84.4 |
| 28 | 50.0 | 1.00 | 0 | 6.12 | 47.3 | 0.18 | 86.6 |
| 29 | 50.0 | 0 | 0.75 | 6.09 | 47.4 | 0.19 | 85.9 |
| 30 | 50.0 | 0 | 1.50 | 6.18 | 47.5 | 0.17 | 87.3 |

It is especially advantageous in the practice of the present invention to employ a carbonaceous material which contains vanadium. The following example is intended to show the benefits derived from the use of these materials.

EXAMPLE III

The same procedures outlined in Example I were followed to prepare various blends containing the vanadiferous clay except that in this instance a vanadium-containing carbon material was employed to replace the charcoal. Specifically, the vanadium-containing carbon material included boiler residue (5.81% $V_2O_5$, 57% C) obtained from the combustion of heavy oil. Flexicoke samples were also employed, these being derived from two separate Flexicoker operations, the Sample I (1.52% $V_2O_5$, 90% C) and Sample II (3.77% $V_2O_5$, 88% C). Virtually all of the carbon in these materials is of the nonvolatile or "fixed" variety. The cylinders made from the various blends were roasted in groups of five at 825° C. for 2 and 4 hours. In one group (Group III), ferrophosphorus (approximately 1.5 g) and open hearth slag (approximately 2.0 g) were also used in each blend. The results of these tests are given in Table III below.

TABLE III

Effect of Vanadiferous Carbon Sources on Salt-Roasting Vanadiferous Clay at 825° C.

| Test | Boiler Residue (g) | Flexicoke I (g) | Flexicoke II (g) | Charcoal (g) | NaCl (g) | Leach Tails Wt (g) | Leach Tails % $V_2O_5$ | % $V_2O_5$ Extd |
|---|---|---|---|---|---|---|---|---|
| | | | Group I. 50 g Ore; Roasts for 4 hr | | | | | |
| 31 | 0 | 0 | 0 | 0 | 6.00 | 47.6 | 0.20 | 85.4 |
| 32 | 1.75 | 0 | 0 | 0 | 6.21 | 48.0 | 0.17 | 89.4 |
| 33 | 0 | 1.10 | 0 | 0 | 6.13 | 47.5 | 0.15 | 89.2 |
| 34 | 0 | 0 | 1.13 | 0 | 6.14 | 47.7 | 0.15 | 89.6 |
| 35 | 0 | 0 | 0 | 1.00 | 6.12 | 47.6 | 0.15 | 88.9 |
| | | | Group II. 50 g Ore; Roasts for 2 hr | | | | | |
| 36 | 0 | 0 | 0 | 0 | 6.00 | 47.5 | 0.25 | 82.0 |
| 37 | 1.75 | 0 | 0 | 0 | 6.21 | 47.7 | 0.19 | 87.7 |
| 38 | 0 | 1.10 | 0 | 0 | 6.13 | 47.7 | 0.19 | 86.2 |
| 39 | 0 | 0 | 1.13 | 0 | 6.14 | 47.5 | 0.19 | 86.8 |
| 40 | 0 | 0 | 0 | 1.00 | 6.12 | 47.1 | 0.19 | 85.5 |
| | | | Group III. 50 g Ore; 1.5 g Ferrophosphorus, 2.0 g Open Hearth Slag; Roasts for 4 hr | | | | | |
| 41 | 0 | 0 | 0 | 0 | 6.42 | 51.8 | 0.19 | 88.4 |
| 42 | 1.75 | 0 | 0 | 0 | 6.63 | 52.3 | 0.18 | 90.1 |
| 43 | 0 | 1.10 | 0 | 0 | 6.55 | 51.9 | 0.16 | 90.6 |
| 44 | 0 | 0 | 1.13 | 0 | 6.56 | 51.7 | 0.16 | 90.8 |
| 45 | 0 | 0 | 0 | 1.00 | 6.54 | 51.8 | 0.16 | 90.4 |

It will be seen from Table III that the use of vanadium-containing carbon materials in the process results in improved vanadium yields. In Group I (tests 31–35) the blends were roasted for four hours. Test 31 served as the control without carbon. In tests 32–35, additives were used in amounts to supply approximately 1 gram of carbon. It is seen that in every case the tails % $V_2O_5$ assays are significantly lower for the roast of blends containing carbon. This shows that the additional vanadium extracted from the ore-carbon source blend (over and above that for the control test 31) was more than that supplied by the carbon source. Hence, the effective extraction of vanadium from the carbon source was 100%, and the effective extraction of vanadium from the ore portion was greater than that from the ore in control test 31. The effect of the carbon source on vanadium extraction is thus seen to be "synergistic". The same effect can be seen for the blends of Group II, which were roasted for two hours. However, the tails $V_2O_5$ assays were somewhat higher than for the analogous four-hour roast.

Table III also shows that the added ferrophosphorus and open hearth slag (Group III) which contain essentially no carbon, did not counteract the synergistic effect of the carbonaceous additive.

EXAMPLE IV

The same procedures as outlined in Example I were followed to prepare additional blends containing vanadiferous clay ore and boiler residue as the vanadium-containing carbon additive. The blends were made with standard boiler residue (carbon-bearing) or boiler residue which was ashed at 750° C. Ashing the boiler residue resulted in a loss in weight of 65.6%; the ash was analyzed to contain 17.23% $V_2O_5$, 0.043% C. One blend was made with no carbon and served as a control. The blends were formed into cylinders and roasted in groups of five at a time for periods of one or two hours at 825° C. The results of these tests are given in Table IV below.

TABLE IV

Comparison of Boiler Residue and Boiler Residue Ash in Salt Roasting Vanadiferous Clay at 825° C.

| Test | Boiler Residue (g) | Boiler Residue Ash (g) | NaCl (g) | Leach Tails Wt (g) | Leach Tails % $V_2O_5$ | % $V_2O_2$ Extd |
|---|---|---|---|---|---|---|
| | | Group I. 50 g Ore; Roasts for 2 hr | | | | |
| 46 | 0 | 0 | 6.00 | 47.4 | 0.22 | 83.7 |
| 47 | 1.75 | 0 | 6.21 | 47.7 | 0.19 | 87.8 |
| 48 | 0 | 0.60 | 6.07 | 47.7 | 0.25 | 84.1 |
| 49 | 3.49 | 0 | 6.42 | 47.9 | 0.19 | 89.2 |
| 50 | 0 | 1.20 | 6.14 | 48.1 | 0.27 | 84.8 |
| | | Group II. 50 g Ore; Roasts for 1 hr | | | | |
| 51 | 0 | 0 | 6.00 | 47.3 | 0.27 | 80.3 |
| 52 | 1.75 | 0 | 6.21 | 47.5 | 0.21 | 86.7 |
| 53 | 0 | 0.60 | 6.07 | 47.6 | 0.29 | 81.6 |
| 54 | 3.49 | 0 | 6.42 | 48.1 | 0.23 | 87.0 |
| 55 | 0 | 1.20 | 6.14 | 48.2 | 0.32 | 81.9 |

Table IV illustrates that the nonvolatile inorganic constituents left from ashing boiler residue at 750° C. do not contribute to the synergistic effect of the unashed (carbon-bearing) boiler residue. The salt roast blends of tests 48, 50, 53 and 55 contain the vanadium equivalent as ash that analogous feed blends of tests 47, 49, 52 and 54 contain as unashed residue. The tails $V_2O_5$ assays are lower than the control for tests containing carbon-bearing boiler residue but higher than the control for tests containing residue ash.

EXAMPLE V

The same procedures outlined in Example I were followed to prepare additional blends containing the vanadiferous clay ore and boiler residue ash except that in this instance charcoal was added to the residue ash in an amount approximately the equivalent to the carbon burnt off during the ashing step. The blends were formed into cylinders and roasted in the same manner for two hours at 825° C. Table V below shows the results of these tests.

TABLE V

Effect of Charcoal on Salt Roasting Ore and Boiler Residue Ash for 2 Hr at 825° C.

| Test | Ore (g) | Boiler Residue Ash (g) | Charcoal (g) | NaCl (g) | Leach Tails Wt (g) | Leach Tails % $V_2O_5$ | % $V_2O_5$ Extd |
|---|---|---|---|---|---|---|---|
| 56 | 50.0 | 0 | 0 | 6.00 | 47.5 | 0.26 | 80.8 |
| 57 | 50.0 | 0.60 | 0 | 6.07 | 47.7 | 0.33 | 78.4 |
| 58 | 50.0 | 0.60 | 1.00 | 6.19 | 47.7 | 0.22 | 85.4 |
| 59 | 50.0 | 0 | 1.00 | 6.12 | 47.3 | 0.19 | 85.9 |

It will be seen from Table V that adding charcoal to the boiler residue ash in amounts sufficient to replace the carbon that is burned off during ashing results in the return of the synergistic effect described in the earlier Example III. This again is evidence that the carbon component of the boiler residue is in fact responsible for the synergistic effect obtained in extracting the vanadium.

EXAMPLE VI

The same procedures outlined in Example I were again followed to prepare additional blends containing the vanadiferous clay ore, charcoal or boiler residue, along with varying amounts of NaCl. Again, the blends were formed into cylinders and roasted in groups of five at a time for two hours at 825° C. Table VI below shows the results of these tests.

TABLE VI

Effect of Salt on Roasting Ore and Carbon Source for 2 Hr at 825° C.

| Test | NaCl (g) | Leach Tails Wt (g) | Leach Tails % $V_2O_5$ | % $V_2O_5$ Extd |
|---|---|---|---|---|
| | Group I. 50 g Ore, 1.75 g Boiler Residue | | | |
| 60 | 4.00 | 47.7 | 0.30 | 80.6 |
| 61 | 5.00 | 47.8 | 0.23 | 85.9 |
| 62 | 6.00 | 47.8 | 0.24 | 84.7 |
| 63 | 7.00 | 47.8 | 0.21 | 86.4 |
| 64 | 8.00 | 47.7 | 0.19 | 87.7 |
| | Group II. 50 g Ore, 1.00 g Charcoal | | | |
| 65 | 4.00 | 47.5 | 0.26 | 80.6 |
| 66 | 5.00 | 47.4 | 0.23 | 83.1 |
| 67 | 6.00 | 47.4 | 0.21 | 84.3 |
| 68 | 7.00 | 47.2 | 0.18 | 86.5 |
| 69 | 8.00 | 47.3 | 0.19 | 85.9 |

The amount of salt added to the feed blend is not critical but should be sufficient for complete sodium vanadate formation and for any sodium-consuming side reactions which are likely to occur. The amount to be used should be determined experimentally for each particular vanadium ore. If essentially all of the salt is consumed during roasting, i.e., if the water-soluble chloride in the roasted product is negligible, then the quantity of salt used was insufficient. Generally, at least about 5 to 10% of the initial salt should remain unconsumed under optimum roast conditions of time and temperature to ensure effective conversion of vanadium to a water soluble state. For the Arkansas vanadiferous clay used in the examples, about 6 to 8% NaCl (weight basis) is required in the feed blend to insure less than total salt consumption during a two to four hour roast period at 825° C. Table VI shows the results of roasts with 4–8 g blend NaCl/50 g ore containing either 1.75 g boiler residue (Group I) or 1.00 g charcoal (Group II). The trend is toward lower % $V_2O_5$ in the tails when increasing amounts of salt are present in the feed. Beyond about 5 g NaCl/50 g ore, the effect of salt is slight.

EXAMPLE VII

The same procedures outlined in Example I were followed to prepare additional blends containing the vanadiferous clay ore and either charcoal or boiler residue as the carbon source. In one blend (control) no carbon was used at all. The blends were formed into cylinders and roasted for two hours at different roast temperatures, i.e., 800° C. and 775° C. The effect of temperature on the extraction process was then observed for these two groups and compared with samples from earlier tests (Group I) roasted at 825° C. The results are shown in Table VII.

TABLE VII

Effect of Temperature on Salt Roasting Ore and Carbon Source for 2 Hr

| Test | Boiler Residue (g) | Charcoal (g) | NaCl (g) | Leach Tails Wt (g) | Leach Tails % $V_2O_5$ | % $V_2O_5$ Extd |
|---|---|---|---|---|---|---|
| | | Group I. 50 g Ore; 825° C. | | | | |
| 36 | 0 | 0 | 6.00 | 47.5 | 0.25 | 82.0 |
| 37 | 1.75 | 0 | 6.21 | 47.7 | 0.19 | 87.7 |
| 40 | 0 | 1.00 | 6.12 | 47.1 | 0.19 | 85.5 |
| | | Group II 50 g Ore; 800° C. | | | | |
| 70 | 0 | 0 | 6.00 | 47.6 | 0.27 | 80.0 |
| 71 | 1.75 | 0 | 6.21 | 47.8 | 0.26 | 83.5 |
| 72 | 0 | 1.00 | 6.12 | 47.4 | 0.20 | 85.2 |
| | | Group III 50 g Ore; 775° C. | | | | |
| 73 | 0 | 0 | 6.00 | 47.5 | 0.33 | 76.1 |
| 74 | 1.75 | 0 | 6.21 | 47.9 | 0.28 | 82.0 |
| 75 | 0 | 1.00 | 6.12 | 47.4 | 0.21 | 84.3 |

The roast temperature should be chosen such that the optimum amount of vanadium can be extracted within a reasonably short period of time. The optimum temperature for roasting Arkansas vanadiferous clay is approximately 825° C. Increasing the temperature significantly, e.g., to 875°–900° C., results in formation of lesser amounts of water soluble vanadium. This is caused in part by an increase in the rate of side reactions which consume sodium and which result in products that tie up vanadium chemically or mechanically. Too low a temperature can give reduced yields also, a result of slower conversion to sodium vanadate. Table VII shows that improved yields are still obtained for the carbon sources at 800° C. and 775° C., but the amount of vanadium extracted is lower than for roasts at 825° C. The table also indicates that the same yield obtained for roasts at 825° C. can be achieved at lower temperatures by adding carbon.

I claim:

1. A process for extracting vanadium values from a vanadium-bearing ore which comprises, in combination:

preparing a finely divided mixture of the vanadium-bearing ore, a carbonaceous material selected from the group consisting of charcoal, coke, and nonvolatile carbonaceous residues derived from the combustion of petroleum, and an alkali metal salt;

roasting the mixture so prepared in an oxidizing atmosphere at an elevated temperature sufficient to oxidize the vanadium-bearing ore and produce water soluble vanadium values, and for a period of time sufficient to burn off substantially all of the carbon in the mixture;

water-leaching the roast residue to dissolve the soluble vanadium values; and recovering the soluble vanadium values.

2. A process according to claim 1 wherein said carbonaceous material also contains vanadium.

3. A process according to claim 2 wherein said carbonaceous material is the residue from the combustion of heavy oil.

4. A process according to claim 2 wherein said carbonaceous material is the residue from the refining of heavy crude oil by the Flexicoking process.

5. A process according to claim 2 wherein said carbonaceous material is a residue obtained from the combustion of a petroleum oil containing from about 1 to 6% by weight vanadium.

6. A process according to claim 1 wherein the vanadium-bearing ore is a high silica clay ore and wherein the roast temperature is maintained in the range of between about 800° and 850° C.

7. A process according to claim 1 wherein the roast is maintained for a period of time between about 2 and 4 hours.

8. A process according to claim 1 wherein the ingredients of said mixture are sized to approximately −100 mesh or finer.

9. A process according to claim 1 wherein the alkali metal salt is selected from a group consisting of NaCl, KCl, $Na_2SO_4$, $NaNO_3$, $Na_2CO_3$ and mixtures thereof.

10. A process according to claim 9 wherein the alkali metal salt is sodium chloride.

11. A process according to claim 1 wherein said oxidizing atmosphere is air, oxygen or oxygen enriched air.

12. A process according to claim 1 in which said oxidizing atmosphere contains moisture.

13. A process according to claim 1 wherein the vanadate recovered from the aqueous leach liquor is reacted with an ammonium salt to precipitate ammonium metavanadate and wherein the ammonium metavanadate is converted to vanadium oxide.

14. A process for extracting vanadium values from a vanadium-bearing ore which comprises, in combination:

preparing a finely divided mixture of the vanadium-bearing ore, carbon and an alkali metal salt selected from the group consisting of sodium chloride, potassium chloride, sodium sulfate, sodium nitrate, sodium carbonate and mixtures thereof;

roasting the mixture so prepared in an oxidizing atmosphere at elevated temperatures above about 800° C. to oxidize the vanadium-bearing ore and produce water soluble vanadium values, the roasting being carried out for a period of time sufficient to burn off substantially all of the carbon in the mixture;

water-leaching the roast residue to dissolve the soluble vanadium values; and recovering the soluble vanadium values.

15. In a process for extracting vanadium values from a vanadium-bearing ore comprising preparing a finely divided mixture of the vanadium-bearing ore and an alkali metal salt, roasting the mixture in an oxidizing atmosphere at an elevated temperature sufficient to oxidize the vanadium-bearing ore and produce water soluble vanadium values, water-leaching the roast residue to dissolve the soluble vanadium values and then recovering the soluble vanadium values; the improvement which comprises, in combination:

(a) adding to the mixture vanadium-bearing, high carbon residues obtained from the combustion of heavy crude oil; and (b) roasting said mixture in an oxidizing atmosphere at a temperature above about 800° C. for a period of time sufficient to burn off substantially all of the carbon in the mixture.

* * * * *